United States Patent [19]

Steward

[11] Patent Number: 4,672,942

[45] Date of Patent: Jun. 16, 1987

[54] TARGET THROWING APPARATUS

[76] Inventor: Ronald R. Steward, P.O. Box 163, Altona, Ill. 61414

[21] Appl. No.: 802,736

[22] Filed: Nov. 29, 1985

[51] Int. Cl.[4] ..... F41B 15/00; F41B 11/00

[52] U.S. Cl. ..... 124/1; 124/78; 124/82

[58] Field of Search ..... 124/1, 50, 51, 6, 78, 124/41 R, 81, 82

[56] References Cited

U.S. PATENT DOCUMENTS

| | | | |
|---|---|---|---|
| 783,523 | 2/1905 | Hoffman | 124/50 |
| 1,211,738 | 1/1917 | Marty | 124/1 |
| 2,716,973 | 9/1955 | Desi | 124/78 |
| 4,116,438 | 9/1978 | Berliner | 124/1 |

FOREIGN PATENT DOCUMENTS

| | | | |
|---|---|---|---|
| 45428 | 4/1977 | Japan | 124/82 |

*Primary Examiner*—Richard C. Pinkham
*Assistant Examiner*—Gary Jackson
*Attorney, Agent, or Firm*—Norman B. Rainer

[57] ABSTRACT

An apparatus for propelling metal cans into the air for target use with a BB gun utilizes a motor-driven launching wheel having a resilient perimeter, and a gripping surface spaced apart from the perimeter by a distance equal to the diameter of the can to be launched. A downwardly inclined feed ramp sends cans to a launching arm which is raised by a solenoid so as to place the can between the wheel and gripping surface.

8 Claims, 5 Drawing Figures

TARGET THROWING APPARATUS

BACKGROUND OF THE INVENTION

This invention relates to apparatus for propelling light weight target objects upwardly for the benefit of a shooter, and is more particularly concerned with apparatus for propelling metal cans into the air for target use with a BB gun.

The use of target throwing devices in skeet and trap shooting pastimes is well known. Such devices generally utilize spring mechanisms which throw a fragile disc-like clay "pigeon" into a prescribed airborne trajectory. The clay pigeon targets are fired upon by a shotgun, and hits are recorded by visually observing the breaking of the target in mid-air. Such shooting pastimes involve considerable expense because of the cost of the 5 clay targets and ammunition. Furthermore, the large shooting area required and the extensive noise rule out such activities in highly populated areas.

Air rifles which shoot a small spherical projectile known as a BB are in widespread use. Because they are quiet and of limited power, air rifles can be used closer to populated areas, thereby permitting target shooting without necessitating travel to distant shooting ranges.

It has been found desirable to utilize empty thin-walled metal cans as airborne targets. Such cans, sometimes referred to as "tin" cans are generally fabricated of iron or aluminum, and find widespread use in the packaging of beverages and other food products. When struck by a BB, the cans produce a noise but are substantially undamaged and can be used repeatedly. The cans thereby constitute economical targets, while providing an audible hit recording characteristic.

The scoring of a hit upon an airborne target is more difficult with a BB gun than with a shotgun whose impact pattern covers a relatively large area. Therefore, airborne targets for BB use must follow a relatively close and consistent trajectory. In attempts to utilize a clay pigeon thrower to throw tin cans, it is generally found that the can trajectory is too distant and erratic for BB gun use.

It is accordingly an object of this invention to provide apparatus for propelling metal cans for target use by a BB gun.

It is another object of this invention to provide apparatus as in the foregoing object capable of propelling metal cans upwardly from a ground location into substantially reproducible airborne trajectories.

It is a further object of the present invention to provide apparatus of the aforesaid nature of rugged and durable construction amenable to low cost manufacture.

These objects and other objects of the invention will be apparent from the following description.

SUMMARY OF THE INVENTI0N

The above and other beneficial objects and advantages are accomplished in accordance with the present invention by a can throwing apparatus comprising:

(a) a launching arm mounted upon pivot means permitting reciprocative rotative motion of said arm in a vertical path, said arm having a control extremity and positioning extremity, (b) manipulating means associated with said control extremity ior moving said positioning extremity to alternating raised and lowered positions, (c) a launching wheel adapted to rotate continuously at a constant high rate of speed in a vertical plane, said wheel being positioned above said launching arm and having a perimeter comprised of resilient material, (d) an electric motor adapted to drive said launching wheel, (e) upwardly directed gripping means spaced apart from the perimeter of said wheel and in facing relationship therewith, (f) feed means adapted to confine a multitude of metal cans having circular cylindrical sidewalls in axially parallel abutting relationship and further adapted to deposit said cans by rolling movement about said sidewalls sequentially upon the positioning extremity of said launching arm, and (g) means for limiting the movement of cans from the feed means to said positioning extremity, whereby (h) when the positioning extremity is in its lowered position it receives one can from said feed means, and when in its raised position places the sidewall of said can into spanning contact with both the perimeter of said wheel and said gripping means, whereby (i) the can is propelled upwardly from said apparatus with an axial spin which stabilizes the path taken by the can.

In preferred embodiments, the manipulating means is an electrically activated solenoid capable of pulling or pushing the control extremity of the launching arm, thereby causing pivoting of the positioning extremity to its raised position. Restoration of the positioning extremity to its lowered position may be achieved by gravity effect, spring means, or reversal of the solenoid motion. The solenoid is preferably adapted to operate from the same electrical source that powers said electric motor. The gripping means preferably has a resilient surface and may either have a straight configuration tangentially oriented to the wheel but spaced apart therefrom, or may have some curvature following the curvature of the wheel. In other embodiments the gripping means may be a moving member such as a wheel or belt. The feed means is preferably comprised of a ramp downwardly angled toward said launching arm, and having side retaining means.

BRIEF DESCRIPTION OF THE DRAWING

For a fuller understanding of the nature and objects of the invention, reference should be had to the following detailed description taken in connection with the accompanying drawing forming a part of this specification and in which similar numerals of reference indicate corresponding parts in all the figures of the drawing.

DESCRIPTION OF THE PREFERRED EMBODIMENT

Figure 1:
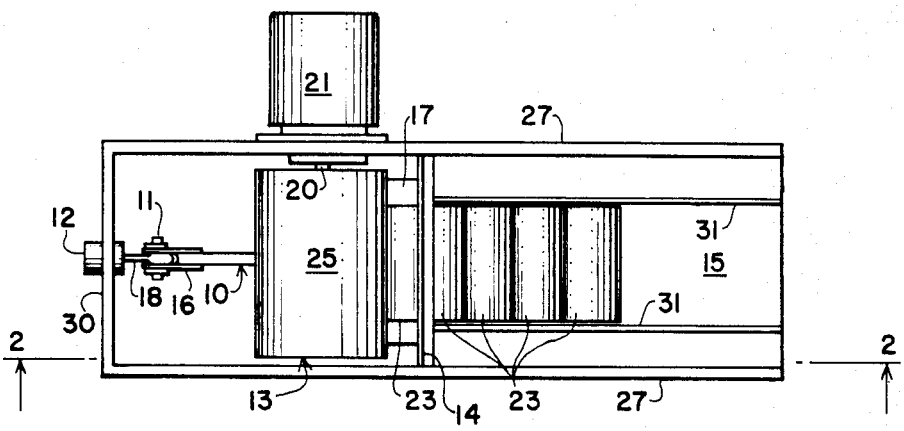
FIG. 1 is a top view of an embodiment of the apparatus of the present invention showing cans operatively associated therewith.
Figure 2:
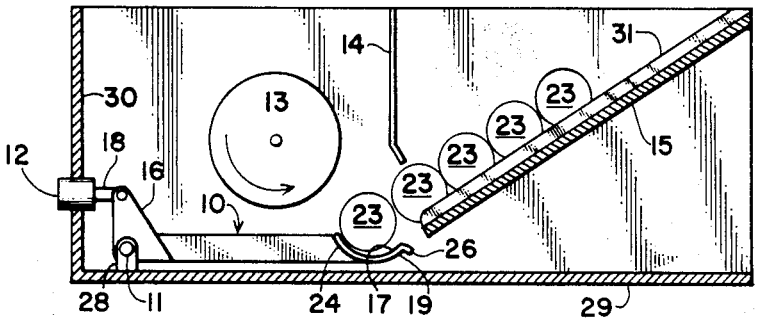
FIG. 2 is a sectional view taken along the line 2—2 of FIG. 1.
Figure 3:
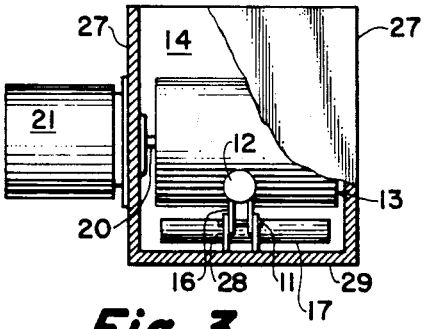
FIG. 3 is a view taken from the left end of FIG. 1, with portions broken away to reveal interior details.
Figure 4:
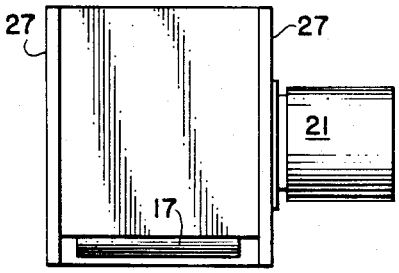
FIG. 4 is a view taken from the right end of FIG. 1.
Figure 5:
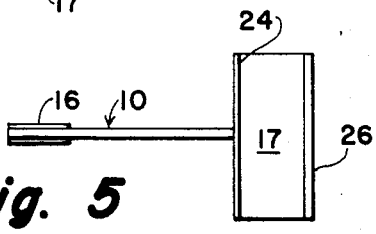
FIG. 5 is a top view of the launching arm employed in the embodiment of FIGS. 1–4.

Referring to tbe drawing, an embodiment of the apparatus of this invention is shown comprised of launching arm 10 mounted upon pivot pin 11, a manipulating solenoid 12 in operative engagement with said arm, launching wheel !3 positioned above said arm, upwardly directed gripping means 14 horizontally spaced from said wheel and vertically spaced from said arm, and inclined feed ramp 15 held by parallel side panels 27. Pivot pin 11 is held by mounting post 28 affixed to base panel 29. Solenoid 12 is held by end panel 30 which meets with panels 27 and 29 to form a box-like enclosure.

Said launching arm is comprised of control extremity 16 and positioning extremity 17 disposed in opposed relationship about pivot pin 11. The control extremity, which may be in the form of a hollow or double-faced bracket, has pivotally attached thereto the activating plunger 18 of solenoid 12. The distance between the site of attachment of plunger 18 and pivot pin 11 represents a short lever arm adapted to cause amplified movement of positioning extremity 17. In particular, it is seen that movement of the plunger a small distance toward the solenoid causes a greater distance of upward movement of the positioning extremity. The positioning extremity returns to its lowermost location by force of gravity, or reversal of the plunger motion, or by the optional effect of springs (not shown) . Abutment stop means may be utilized to assure accurate positioning of the launching arm in the two positions. An on-off switch for control of the solenoid may be provided at a convenient distance from the apparatus by way of an electrical extension cord or radiocontrolled means.

A fractional horsepower electric motor 21 mounted to side panel 27 drives the launching wheel at a constant speed about a horizontally disposed axle 20. Electrical current to operate the motor and solenoid may be provided through a single lead-in extension cord. The diameter of the wheel may range from about 6 to 12 inches. The perimeter of the wheel is comprised of a resilient surface 25 of circular cylindric contour having a length between 5 and 8 inches measured in the axial direction of the wheel between its opposite end faces. It is to be noted that the rotational axis of the wheel extends perpendicularly between side panels 27. The resilient characteristics are provided by means of a uniform layer of a rubbery material which may be a synthetic polymer having a foam configuration.

Gripping means 14 may be held by side panels 27 as a single flat surface having high frictional resistance, or may be comprised of a parallel series of ribs or bars of comparable frictional resistance. The gripping means are horizontally spaced from the perimeter of the wheel so that the circular sidewall of a can 23 makes tight tangential contact with both the wheel perimeter and gripping means. The frictional resistance of the gripping means, which may be provided by resilient materials, fibrous pile or felt structures, or other materials, enables the wheel to cause the can to rotate about its axis as it is being upwardly propelled. The spinning effect thereby imparted to the can stabilizes its trajectory. The apparatus is designed so that the thrown spinning can will rise about 15 to 25 feet and will land between about 4 and 10 feet from the apparatus. The spacing between the gripping means and wheel perimeter may be adjustable to accommodate cans of different diameter. As one example of such adjustability, the gripping means may be pendantly supported at its uppermost extremity and urged by gravity or spring effect toward the wheel.

Feed ramp 15 terminates at a lowermost extremity located closely adjacent distal end 19 of the positioning extremity. When the positioning extremity is in its lowered position, a single can will roll onto it from ramp 15, stopping at raised abutment 24 associated with said positioning extremity.

When the positioning extremity is elevated to its raised position, it inserts the can between the wheel perimeter and gripping surface, thereby initiating upward propulsion of the can. At the same time, restraining foot 26 downwardly directed from distal end 19 prevents further advance of additional cans from ramp 15. Paired retaining ribs 31 mounted in parallel juxtaposition upon ramp 15 prevent movement of the cans transversely to the ramp. The same function may however be achieved in some embodiments by side panels 27.

While particular examples of the present invention have been shown and described, it is apparent that changes and modifications may be made therein without departing from the invention in its broadest aspects. The aim of the appended claims, therefore, is to cover all such changes and modifications as fall within the true spirit and scope of the invention.

Having thus described my invention, what is claimed is:

1. A can throwing apparatus comprising:

(a) a launching arm mounted upon pivot means permitting reciprocative rotative motion of said arm in a vertical path, said arm having a control extremity and positioning extremity, (b) manipulating means associated with said control extremity for moving said positioning extremity to alternating raised and lowered positions within said vertical path, (c) a launching wheel adapted to rotate continuously at a constant high rate of speed in a vertical plane, said wheel being positioned above said launching arm and having a circular cylindric perimeter comprised of resilient material, (d) an electric motor adapted to drive said launching wheel, (e) upwardly directed gripping means spaced apart from the perimeter of said wheel and in facing relationship therewith, (f) feed means adapted to confine a multitude of metal cans having circular cylindrical sidewalls in axially parallel abutting relationship and further adapted to deposit said cans by rolling movement about said sidewalls sequentially upon the positioning extremity of said launching arm, and (g) means for limiting the movement of cans from the feed means to said positioning extremity, whereby (h) when the positioning extremity is in its lowered position it receives one can from said feed means, and when in its raised position places the sidewall of said can into spanning contact with both the perimeter of said wheel and said gripping means, whereby (i) the can is propelled upwardly from said apparatus with an axial spin which stabilizes the path taken by the can.

2. The apparatus of claim 1 wherein said manipulating means is an electrically activated solenoid capable of moving the control extremity of the launching arm, thereby causing pivoting of the positioning extremity to its raised position.

3. The apparatus of claim 1 wherein said gripping means has a resilient surface.

4. The apparatus of claim 3 wherein said gripping means has a straight configuration tangentially oriented to said launching wheel.

5. The apparatus of claim 3 wherein said gripping means has some curvature following the curvature of the wheel.

6. The apparatus of claim 3 wherein said gripping means is a rotating wheel.

7. The apparatus of claim 2 wherein said feed means is comprised of a ramp downwardly angled toward said launching arm, and provided with side retaining means.

8. The apparatus of claim 3 wherein the spacing between the gripping means and perimeter of said wheel is adjustable to accommodate cans of different diameter.

* * * * *